US008807472B2

(12) United States Patent
Suzuki

(10) Patent No.: US 8,807,472 B2
(45) Date of Patent: Aug. 19, 2014

(54) WEB WINDING METHOD, PRODUCING METHOD OF A WEB, AND WEB WINDING APPARATUS

(75) Inventor: Takayuki Suzuki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 610 days.

(21) Appl. No.: 12/719,877

(22) Filed: Mar. 9, 2010

(65) Prior Publication Data

US 2010/0230526 A1 Sep. 16, 2010

(30) Foreign Application Priority Data

Mar. 16, 2009 (JP) ..... 2009-062567

(51) Int. Cl.
*G11B 15/66* (2006.01)
*B65H 19/28* (2006.01)

(52) U.S. Cl.
CPC ..... *B65H 19/28* (2013.01); *B65H 2301/41425* (2013.01); *B65H 2301/41368* (2013.01); *B65H 2301/414222* (2013.01); *B65H 2701/378* (2013.01)
USPC ..... 242/332.3; 242/532.2; 242/532.3

(58) Field of Classification Search
USPC ..... 242/332, 332.3, 332.4, 532, 532.2, 242/532.7; 360/95
See application file for complete search history.

(56) References Cited

U.S. PATENT DOCUMENTS

| | | | | |
|---|---|---|---|---|
| 6,883,740 | B2 * | 4/2005 | Hiraguchi | 242/332.4 |
| 7,975,954 | B2 * | 7/2011 | Suzuki | 242/532.2 |
| 2007/0262188 | A1 * | 11/2007 | Kubota | 242/532.2 |
| 2009/0283621 | A1 * | 11/2009 | Suzuki | 242/532.2 |

FOREIGN PATENT DOCUMENTS

| | | |
|---|---|---|
| JP | 2005-259273 A | 9/2005 |
| JP | 2005-327333 | 11/2005 |

OTHER PUBLICATIONS

Partial English language translation of the following: Office action dated Dec. 4, 2012 from the Japanese Patent Office in a Japanese patent application corresponding to the instant patent application. This office action translation is submitted now in order to supplement the understanding of patent document JP 2005-327333 which is cited in the office action and is being disclosed in the instant Information Disclosure Statement.

* cited by examiner

*Primary Examiner* — William A Rivera
(74) *Attorney, Agent, or Firm* — SOLARIS Intellectual Property Group, PLLC

(57) ABSTRACT

In a web winding apparatus for winding a web on a winding core, the winding core is rotated by a predetermined amount while an end portion of the web, which is held by a holding mechanism, is pressed against the winding core. Thereafter, the holding by the holding mechanism is released, and thereby the end portion of the web is attached to the winding core. Thereafter, the winding core is rotated, and the web is wound up on the winding core. A rotation speed of the winding core when the web is being pressed against the winding core is a higher speed than a rotation speed of the winding core at the time of attaching the web to the winding core. In this manner, the web is accurately wound on the winding core.

18 Claims, 15 Drawing Sheets

UP
FR
40
42
44
46
48
48
48
30
38
32
32A
39
54
56A
Tf
52
60
56
54
58A
50
58
55
55
T

WEB WINDING METHOD, PRODUCING METHOD OF A WEB, AND WEB WINDING APPARATUS

CROSS-REFERENCE TO RELATED APPLICATION

This application claims priority under 35 USC 119 from Japanese Patent Application No. 2009-062567, filed on Mar. 16, 2009, the disclosure of which is incorporated by reference herein.

BACKGROUND OF THE INVENTION

1. Field of the Invention

The present invention relates to a method of winding a web on a winding core, a producing method of a wound web, and an apparatus therefor.

2. Description of the Related Art

Conventionally, a reel on which a recording tape such as a magnetic tape is wound, and which is accommodated within a case is known. In such a reel, the recording tape is wound on an outer peripheral surface of a hub thereof after a free end portion of the recording tape is attached thereto. That is, a liquid for recording tape attachment such as alcohol is coated on the outer peripheral surface of the hub, and after attaching the free end portion of the recording tape to the outer peripheral surface of the hub by way of a surface tension of the liquid, the recording tape is wound on the hub (refer to, for example, Japanese Patent Application Laid-Open (JP-A) No. 2005-259273).

However, in the case of such a recording tape winding method, since it is difficult for a drying speed of the liquid for recording tape attachment (alcohol or the like) in a height direction (axis direction) of the hub (winding core) to become uniform, it is easy for the free end portion of the recording tape to slant in the height direction (axis direction) of the hub when the free end portion of the recording tape (web) has been attached to the outer peripheral surface of the hub and the recording tape has begun to be wound on the hub, and in some cases, the free end of the recording tape is attached at a slant. When the recording tape is sequentially wound on the hub in this state, an edge (width direction end portion) of the recording tape may hit a flange, and the edge may be bent over thereby.

SUMMARY OF THE INVENTION

In view of the circumstances described above, the present invention provides a web winding method, a producing method of a wound web, and a web winding apparatus, by which a web can be accurately wound on a winding core.

A web winding method according to a first aspect of the present invention includes: rotating the winding core by a predetermined amount while pressing an end portion of the web, which is held by a holding mechanism, against the winding core, and thereafter, carrying out temporary attachment by attaching the end portion of the web to the winding core by releasing the holding by the holding mechanism; and after the temporary attachment, rotating the winding core to wind up the web on the winding core.

Further, a producing method of a web obtained by winding the web on a winding core according to a second aspect of the present invention includes: rotating the winding core by a predetermined amount while holding an end portion of the web so that the end portion of the web is pressed against the winding core, and thereafter, carrying out temporary attachment in which the end portion of the web is attached to the winding core by releasing the holding; and after the temporary attachment, rotating the winding core to wind up the web on the winding core.

In the methods according to the first and second aspects of the present invention, since a liquid for web attachment or like does not intervene between the end portion of the web and the winding core, a distribution of force in an axis direction of the winding core becomes uniform, and even when the web begins to be wound on the winding core, the end portion of the web does not slant in the axis direction of the winding core. That is to say, a width direction fluctuation force of the web is suppressed as much as possible, and an attachment position of the web becomes stable. Thus, the web can be accurately wound on the winding core.

Further, in the methods according to the first and second aspects of the present invention, a configuration may be provided wherein, in the temporary attachment step, abrasion powder is generated on a contacting surface of the web that contacts the winding core, and the end portion of the web is attached to the winding core by way of the abrasion powder.

In the above methods, since the end portion of the web is attached to the winding core by way of the abrasion powder generated on the contacting surface of the web that contacts the winding core, the distribution of force in the axis direction of the winding core becomes uniform, and even when the web begins to be wound on the winding core, the end portion of the web does not slant in the axis direction of the winding core.

Further, in the methods according to the first and second aspects of the present invention, a configuration may be provided wherein, in the temporary attachment step, the end portion of the web is supported with an elastic body provided at the holding mechanism to press the end portion of the web against the winding core.

According to the above methods, a contacting surface area of the web with respect to the winding core can be increased. That is to say, the end portion of the web can be efficiently pressed against the winding core.

Further, in the methods according to the first and second aspects of the present invention, a configuration may be provided wherein, in the temporary attachment step, a rotation speed of the winding core when the web is being pressed against the winding core is a higher speed than a rotation speed of the winding core at the time of attaching the web to the winding core.

According to the above methods, a production tact time can be improved. That is to say, the longer a contacting distance of the web with respect to the rotating winding core is, the more an attachment force with respect to the winding core increases. Accordingly, if the contacting distance is the same, the faster the rotation speed of the winding core is, the shorter the time in which attachment is carried out is.

Further, in the methods according to the first and second aspects of the present invention, a configuration may be provided wherein, in the temporary attachment step, air is blown out from the holding mechanism toward the web when the holding by the holding mechanism is released.

According to the above methods, the web can be smoothly transferred from the holding mechanism to the winding core, and transfer defects can be prevented from occurring.

Further, a web winding apparatus according to a third aspect of the present invention includes: a rotation mechanism that rotates a winding core; a holding mechanism that is configured to be able to hold a web and configured to be able to move; and a controller that controls the rotation mechanism and the holding mechanism so that the winding core is rotated by a predetermined amount while an end portion of the web, which is held by the holding mechanism, is pressed against the winding core, and thereafter, the winding core is rotated after the holding by the holding mechanism is released.

According to the web winding apparatus of the third aspect of the present invention, since a liquid for web attachment or like does not intervene between the end portion of the web and the winding core, a distribution of force in an axis direction of the winding core becomes uniform, and even when the web begins to be wound on the winding core, the end portion of the web does not slant in the axis direction of the winding core. That is to say, a width direction fluctuation force of the web is suppressed as much as possible, and an attachment position of the web becomes stable. Thus, the web can be accurately wound on the winding core.

Further, in the web winding apparatus according to the third aspect of the present invention, a configuration may be provided wherein the holding mechanism comprises an elastic body that supports the end portion of the web when the end portion of the web is pressed against the winding core.

In the above web winding apparatus, a contacting surface area of the web with respect to the winding core can be increased. That is to say, the end portion of the web can be efficiently pressed against the winding core.

Further, in the web winding apparatus according to the third aspect of the present invention, a configuration may be provided wherein the elastic body is provided within a concave portion formed at the holding mechanism.

In the above web winding apparatus, the end portion of the web held by the holding mechanism can be efficiently pressed against the winding core.

Further, in the web winding apparatus according to the third aspect of the present invention, a configuration may be provided wherein the elastic body is formed with a curved surface shape having a curvature that is equal to or less than a curvature of the winding core.

In the above web winding apparatus, the contacting surface area of the web with respect to the winding core can be further increased.

Further, in the web winding apparatus according to the third aspect of the present invention, the holding mechanism may be configured to hold the web by sucking in air, and to release the web by blowing out air.

In the above web winding apparatus, the web can be smoothly transferred from the holding mechanism to the winding core, and transfer defects can be prevented from occurring.

As described above, according to the present invention, a web winding method, a producing method of a web obtained by winding the web on a winding core, and a web winding apparatus, by which a web can be accurately wound on a winding core, can be provided.

DETAILED DESCRIPTION OF THE INVENTION

Figure 1:
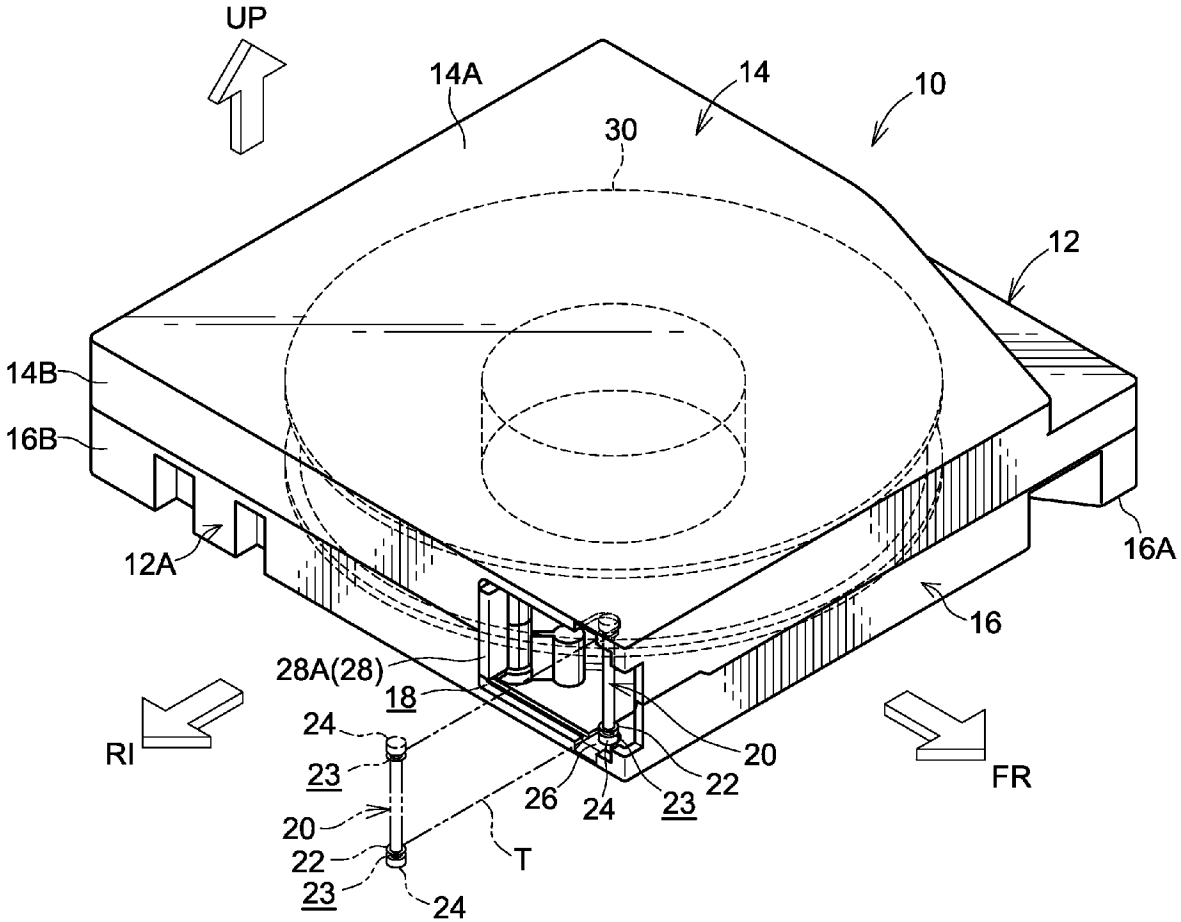
FIG. 1 is a schematic perspective view of a recording tape cartridge.

An exemplary embodiment of the present invention will be explained in detail below based on examples shown in the drawings. Incidentally, it should be noted that since the web winding method and web winding apparatus relating to the present exemplary embodiment can be preferably used for a reel 30 which is singularly accommodated in a recording tape cartridge 10, a recording tape T which is wound on the reel 30 is employed as one example of a web, but that the web winding method and web winding apparatus relating to the present exemplary embodiment can be generally adopted with respect to configurations in which a web is wound after one end portion thereof is attached to an outer peripheral surface of a winding core.

Figure 2A:
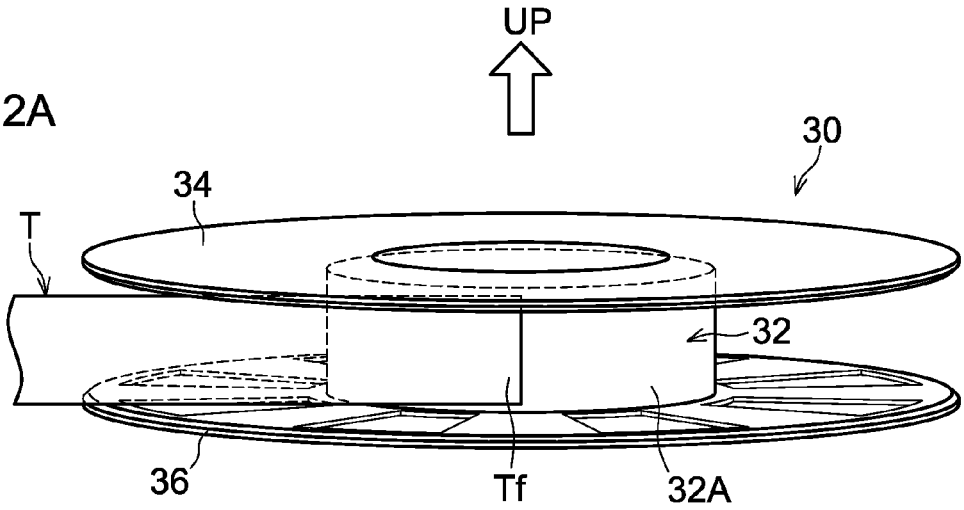
FIG. 2A is a schematic perspective view at a time when a recording tape begins to be wound on a reel.
Figure 2B:
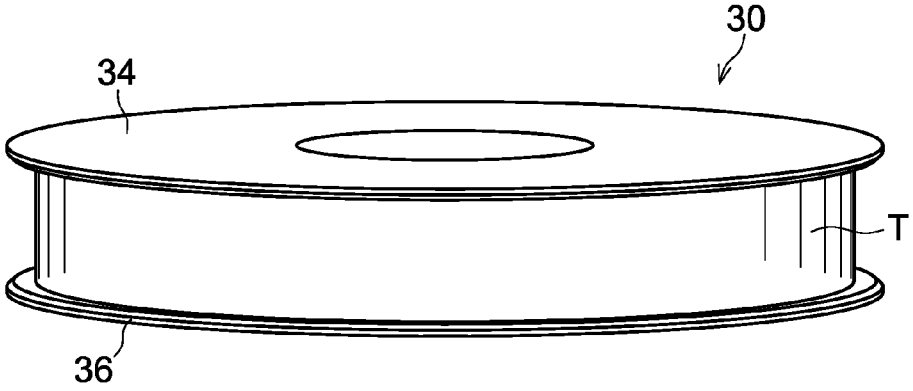
FIG. 2B is a schematic perspective view at a time when the recording tape has finished being wound on the reel.

FIG. 1 is a schematic perspective view of the recording tape cartridge 10, and FIGS. 2A and 2B are schematic perspective views of the reel 30. First, the recording tape cartridge 10 will be briefly explained, and for the sake of convenience of explanation thereof, arrow FR indicates a frontward direction, arrow UP indicates an upward direction, and arrow RI indicates a rightward direction. That is, in the respective drawings, in cases where arrow FR, arrow UP and arrow RI are shown, front and rear, up and down, and left and right are expressed based on the directions indicated by these arrows.

As shown in FIG. 1, the recording tape cartridge 10 has a substantially rectangular box-shaped case 12. The case 12 is configured by joining an upper case 14 and a lower case 16, which are made from resin such as polycarbonate (PC) or the like, by fastening with screws in a state in which peripheral walls 14B provided upright at a periphery of a top plate 14A and peripheral walls 16B provided upright at a periphery of a bottom plate 16A, of the upper case 14 and the lower case 16, respectively, are abutted against each other.

At the inside of the case 12, only one of the reel 30, which is made from resin such as polycarbonate (PC) or the like, is rotatably accommodated. As shown in FIG. 2A, the reel 30 is configured by a cylindrical reel hub 32 having a bottom, which constitutes an axial center portion, a lower flange 36 provided at a lower end portion thereof, and an upper flange 34 provided at an upper end portion thereof, a recording tape T such as a magnetic tape or the like serving as an information recording and playback medium is wound on an outer peripheral surface 32 A of the reel hub 32, and width direction end portions of the wound recording tape T are held by the upper flange 34 and the lower flange 36.

Further, at a lower surface of a bottom wall of the reel hub 32, a reel gear (not illustrated in the drawings) is formed with an annular shape, and at radial direction inner side of the reel gear, an annular reel plate (not illustrated in the drawings) comprising a magnetic material is integrally fixed by insert molding or the like. At a radial direction inner side of the reel plate, a through hole 39 (refer to FIG. 4 through FIG. 9B) for operation of a brake member which will be described later is provided so as to penetrate through.

Further, at a substantial center portion of the lower case 16, a gear opening (not illustrated in the drawings) for exposing the reel gear and the reel plate to the exterior is provided so as to penetrate through, and the reel 30 is configured to be able to rotate relative to the case 12 within the case 12, due to the reel gear, which is exposed from the gear opening, being engaged and rotationally driven by a drive gear (not illustrated in the drawings) formed at a rotation shaft (not illustrated in the drawings) of a drive device.

Further, at the upper surface of the bottom wall of the reel hub 32, an engagement gear 38 (refer to FIG. 4 to FIG. 9B) is formed with an annular shape, and the engagement gear 38 is configured so as to engage with a braking gear of a brake member (not illustrated in the drawings) that is made to be non-rotatable with respect to the case 12 (upper case 14), at a time of non-use (when not loaded into the drive device). That is to say, the reel 30 is configured so as not to inadvertently rotate within the case 12 at a time of non-use, due to the braking gear of the brake member engaging with the engagement gear 38.

Further, at a right wall 12A of the case 12, an opening 18 for pulling out the recording tape T wound on the reel 30 is formed, and at a free end portion of the recording tape T which is pulled out from the opening 18, a leader pin 20 which undergoes a pull out operation while being latched (engaged) by a pull-out member (not illustrated in the drawings) of the drive device is fixed.

At both axis direction end portions of the leader pin 20, thick plate-shaped large flange portions 24 are integrally provided, and at axis direction inner sides of the large flange portions 24, thin plate-shaped small flange portions 22 are integrally provided so as to be separated at a predetermined clearance. The free end portion of the recording tape T is fixed between the small flange portions 22, and spaces between the small flange portions 22 and the large flange portions 24 are configured as annular grooves 23 at which hooks or the like of the pull-out member of the drive device are latched.

Further, at an inner side of the opening 18 of the case 12, that is, at an inner surface of the top plate 14A of the upper case 14 and an inner surface of the bottom plate 16A of the lower case 16, a pair of upper and lower pin holding portions 26 that position and hold the leader pin 20 within the case 12 are provided. The pin holding portions 26 have a substantially semicircular shape whose recording tape T pull-out side is open, and the large flange portions 24 of the leader pin 20 in an upright state are configured to be able to enter and exit the inside of the pin holding portions 26 from the open side.

Further, in the vicinity of the pin holding portions 26, plate springs (not illustrated in the drawings) are fixedly disposed, and fork-shaped distal end portions of the plate springs are configured to respectively engage with the large flange portions 24 of the leader pin 20 to hold the leader pin 20 in the pin holding portions 26. The distal end portions of the plate springs are configured so as to undergo appropriate elastic deformation to permit movement of the leader pin 20 when the leader pin 20 enters and exits the pin holding portions 26.

Further, the opening 18 is opened and closed by a door 28. The door 28 is formed with a substantially rectangular plate shape of a size that can close off the opening 18 and is biased by an unillustrated biasing member in a direction in which the opening 18 is closed off. At a front end portion of the door 28, a convex portion 28A for an opening and closing operation is provided so as to protrude outward. The convex portion 28A is configured so as to engage with an opening and closing member (not illustrated in the drawings) of the drive device accompanying loading of the recording tape cartridge 10 into the drive device, whereby the door 28 is opened against a biasing force of the biasing member.

As shown in FIG. 2B, the recording tape T is wound on the reel 30 of the recording tape cartridge 10 having a configuration such as described above. That is to say, as shown in FIG. 2A, a free end portion Tf (at an opposite side from the free end portion to which the leader pin 20 is attached) of the recording tape T is attached to the outer peripheral surface 32A of the reel hub 32, and thereafter, the recording tape T is sequentially wound on the reel hub 32 due to the reel 30 being rotated. Next, a winding apparatus 40 that winds the recording tape T on the reel hub 32 will be explained.

Figure 3:
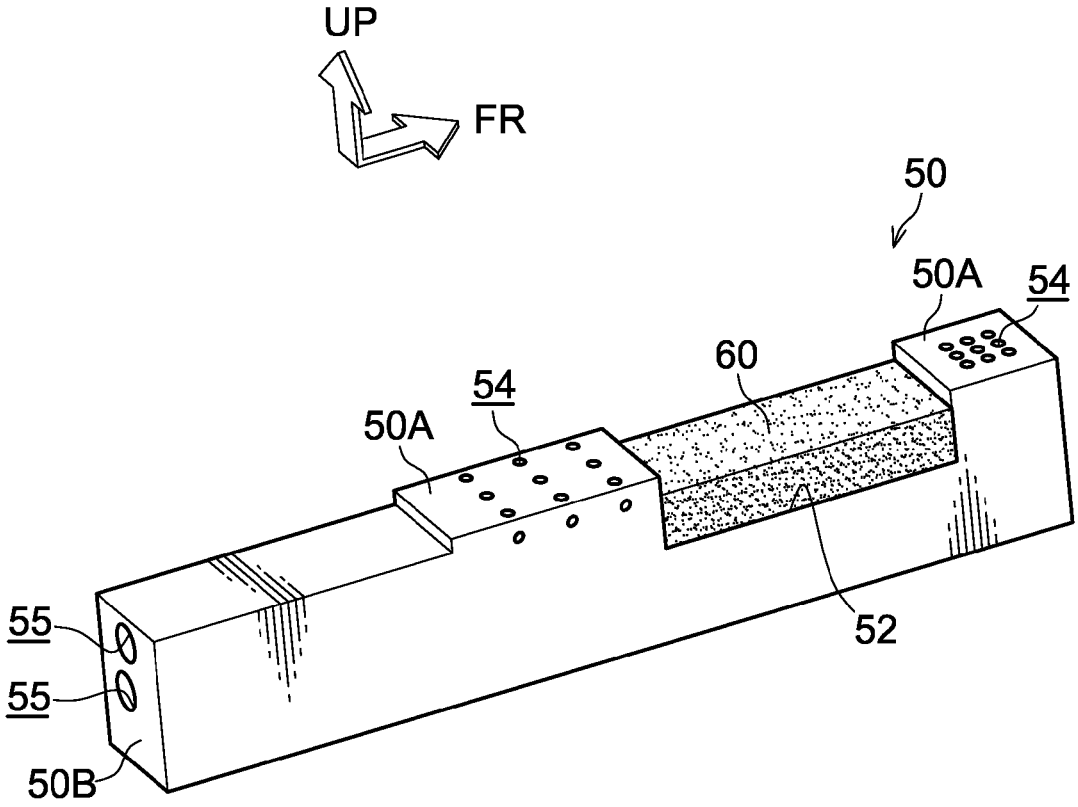
FIG. 3 is a schematic perspective view of a holding mechanism provided at a winding apparatus.
Figure 7:
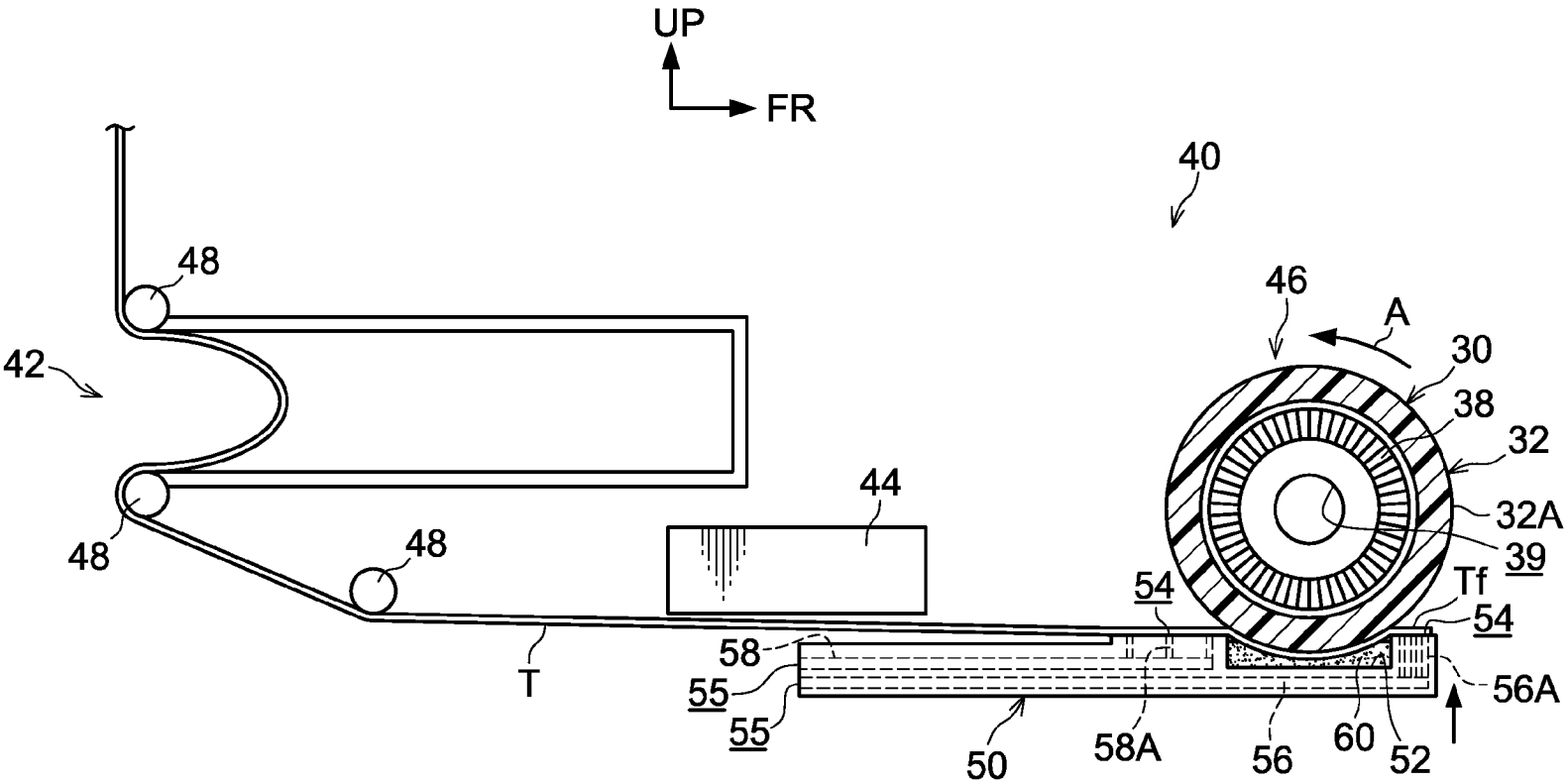
FIG. 7 is an explanatory view showing a step in which the reel hub, against which the recording tape which has been held by the holding mechanism has been pressed, is rotated.
Figure 8:
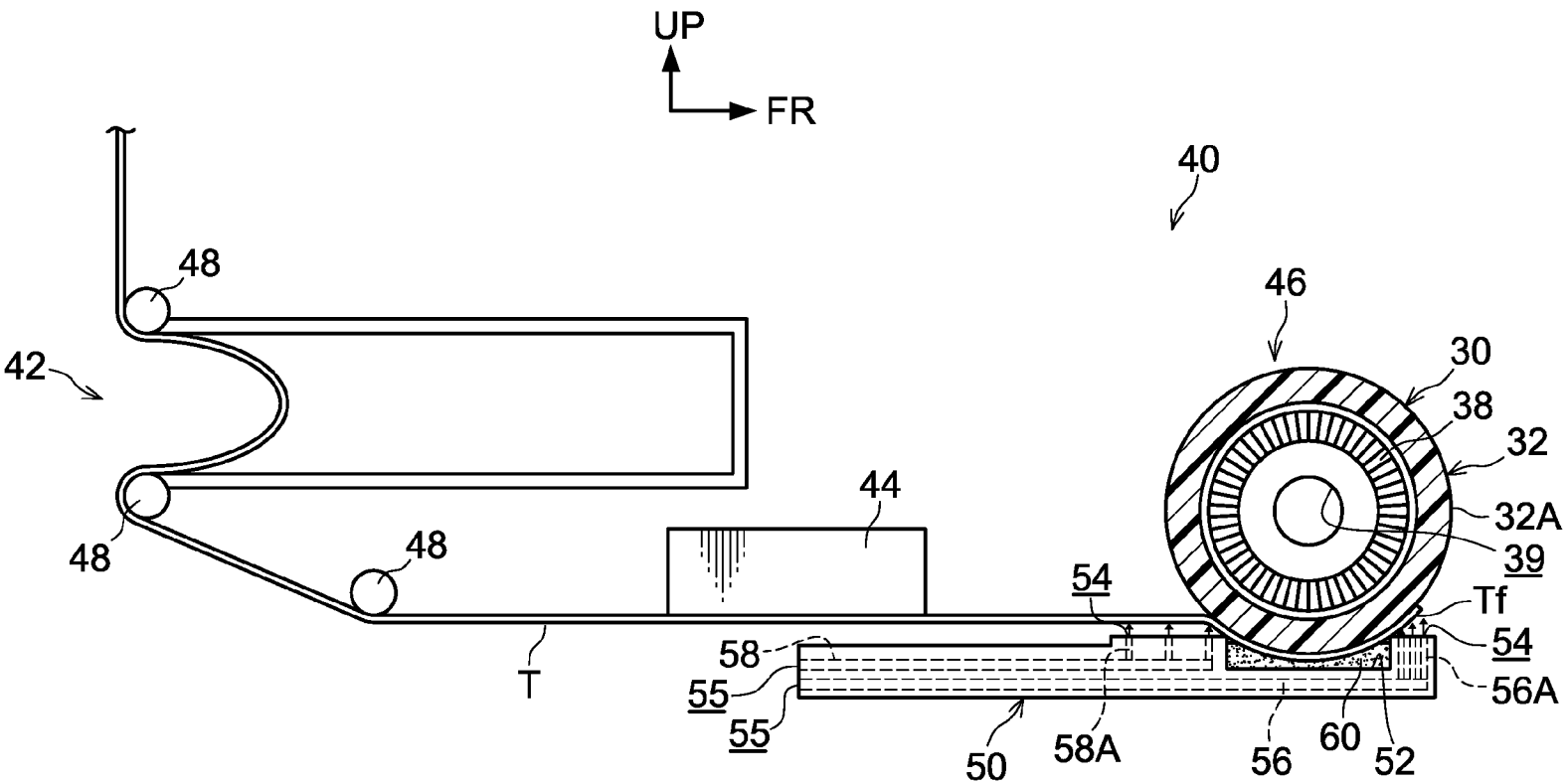
FIG. 8 is an explanatory view showing a step in which air is blown out from the holding mechanism to transfer the recording tape to the reel hub.
Figure 9A:
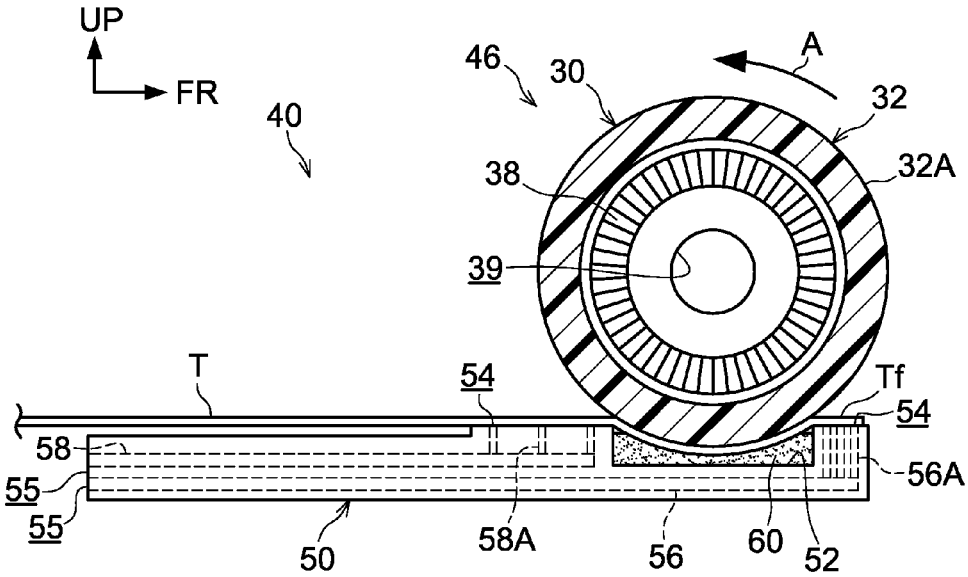
FIG. 9A is an enlarged explanatory view showing the step in which the reel hub, against which the recording tape which has been held by the holding mechanism has been pressed, is rotated.
Figure 9B:
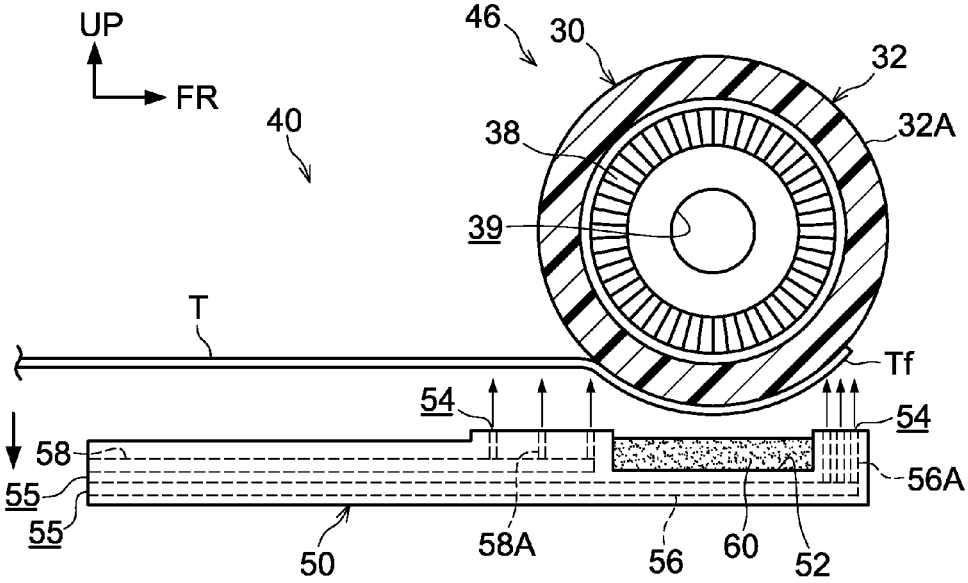
FIG. 9B is an enlarged explanatory view showing a step in which the holding mechanism which has attached the recording tape to the reel hub is separated from the reel hub.

FIG. 3 is a schematic perspective view of a holding mechanism 50 provided at the winding apparatus 40, and FIG. 4 through FIG. 8 are explanatory views showing respective steps for attaching the recording tape T to the outer peripheral surface 32A of the reel hub 32 in the winding apparatus 40. Further, FIG. 9A and FIG. 9B are enlarged explanatory views showing steps for transferring the recording tape T from the holding mechanism 50 to the reel hub 32.

As shown in FIG. 4 through FIG. 8, the winding apparatus 40 comprises a feed-out mechanism 42 for the recording tape T, a suction platform 44 that temporarily holds by suction the free end portion Tf of the recording tape T, a rotation mechanism 46 that holds and rotates the reel 30, and the holding mechanism 50 that holds by suction the free end portion Tf of the recording tape T and moves. Incidentally, it should be noted that in FIG. 4 through FIG. 9B, in order to simplify the explanation (drawings), only the reel hub 32 of the reel 30 is shown in a plane cross-sectional view.

In the feed-out mechanism 42, plural guide rollers 48 that guide the recording tape T are provided. At a lower surface of the suction platform 44, plural through holes (not illustrated in the drawings) are provided so as to penetrate through, and an air suction device (not illustrated in the drawings) is communicated and connected with the respective through holes via tubes (not illustrated in the drawings). Accordingly, the recording tape T is held by suction at the lower surface of the suction platform 44 due to air being sucked in from the respective through holes by the air suction device.

Further, in the rotation mechanism 46, a rotation drive gear (not illustrated in the drawings) is provided with an annular shape, and at a radial direction inner side of the rotation drive gear, a magnet (not illustrated in the drawings) that rotates together with the rotation drive gear is provided. Accordingly, the real hub 32 is able to rotate while being held by the rotation mechanism 46, due to the reel gear formed at the lower surface of the bottom wall of the real hub 32 engaging with the rotation drive gear, and the reel plate being adsorbed by the magnet.

Below the suction platform 44, the holding mechanism 50, which is configured to be able to hold by suction the recording tape T and to be able to move, is provided. As shown in FIG. 3, the holding mechanism 50 is formed with an elongated, substantially rectangular box shape, and the interior thereof is made to be hollow. In the vicinity of the front end (further toward the front end side than a longitudinal direction center) of the holding mechanism 50, a concave portion 52 having a predetermined depth is formed, and within the concave portion 52, a rectangular-shaped elastic body 60 is fixed by fixing means such as an adhesive or the like.

The elastic body 60 is configured by a sponge-like substance provided with a moderate hardness (for example, a hardness of 22 according to a measurement method pursuant to SRIS 0101) and is configured so as to support the recording tape T from a lower side so that the recording tape T can be efficiently contacted with the outer peripheral surface 32A of the reel hub 32 (so as to increase the contacting surface area) when the recording tape T which is held by suction by the holding mechanism 50 is pressed against (pressure contacted with) the outer peripheral surface 32A of the reel hub 32.

Further, at an upper surface 50A of the holding mechanism 50 at both sides (front side and rear side) of the concave portion 52 (elastic body 60), plural through holes 54 are formed. As shown in FIG. 4 through FIG. 8, the respective through holes 54 are communicated and connected with plural connection portions 56A and 58A provided at one end portions of a front side tube 56 and a rear side tube 58, respectively, and as shown in FIG. 3, other end portions of the front side tube 56 and the rear side tube 58 are respectively drawn out from through holes 55, which are formed at a rear end side wall surface 50B of the holding mechanism 50, and communicated and connected with an air suction and supply device (not illustrated in the drawings).

Accordingly, a configuration is provided wherein, when air is sucked by the air suction and supply device, the air is sucked from the respective through holes 54, and the recording tape T is held by suction at the upper surface 50A of the holding mechanism 50. Further, a configuration is provided wherein, when air is supplied from the air suction and supply device, the air is blown out from the respective through holes 54, and the recording tape T is released from the upper surface 50A of the holding mechanism 50 as will be described later.

Furthermore, the holding mechanism 50 is configured so as to be capable of forward movement (movement in an arrow FR direction), backward movement (movement in an opposite direction from the arrow FR direction), ascending movement (movement in an arrow UP direction) and descending movement (movement in an opposite direction from the arrow UP direction), due to an unillustrated moving mechanism such as a linear guide or an air cylinder. That is to say, the holding mechanism 50 is capable of movement approaching and moving away from the reel hub 32, and capable of contacting (pressure contacting) the elastic body 60 provided within the concave portion 52 with the reel hub 32 and separating the elastic body 60 from the reel hub 32, in a state in which the recording tape T is held by suction.

Figure 4:
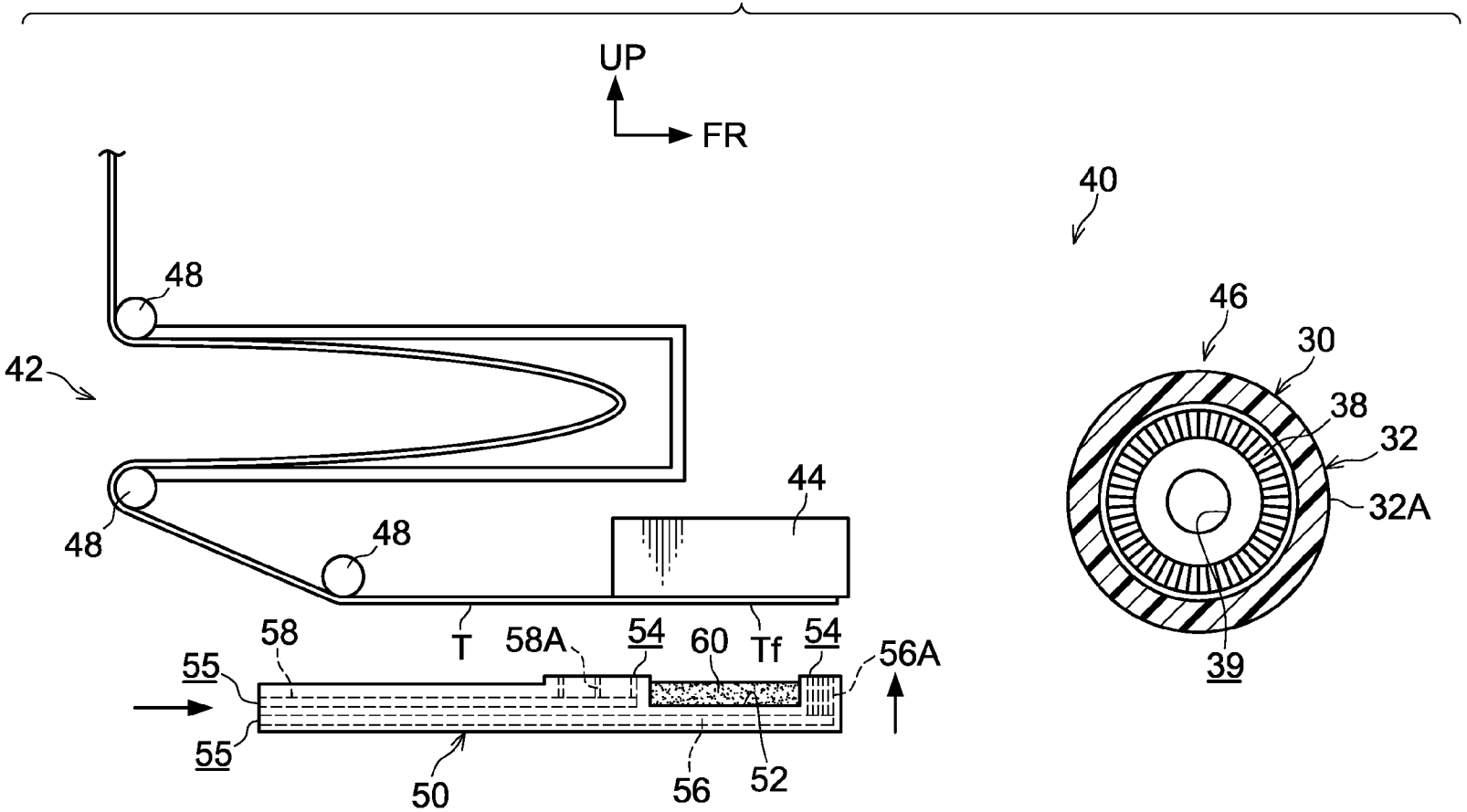
FIG. 4 is an explanatory view showing a step in which the holding mechanism holds the recording tape which is held at a suction platform.

Next, the operation of the winding apparatus 40 and the holding mechanism 50 configured such as described above will be explained based mainly on FIG. 4 through FIG. 9B. As shown in FIG. 4, the free end portion Tf of the recording tape T, which has been fed out through the respective guide rollers 48 by the feed-out mechanism 42, is held by suction at the suction platform 44. That is to say, due to air being sucked from the respective through holes by the air suction device, the free end portion Tf of the recording tape T is temporarily held by suction at the lower surface of the suction platform 44.

Meanwhile, the reel 30 is set at the rotation mechanism 46. That is to say, the reel gear formed at the lower surface of the bottom wall of the reel hub 32 is engaged with the rotation drive gear, and the reel plate is adsorbed by the magnet. Further, the holding mechanism 50 undergoes forward movement to a position below the suction platform 44 and waits.

Figure 5:
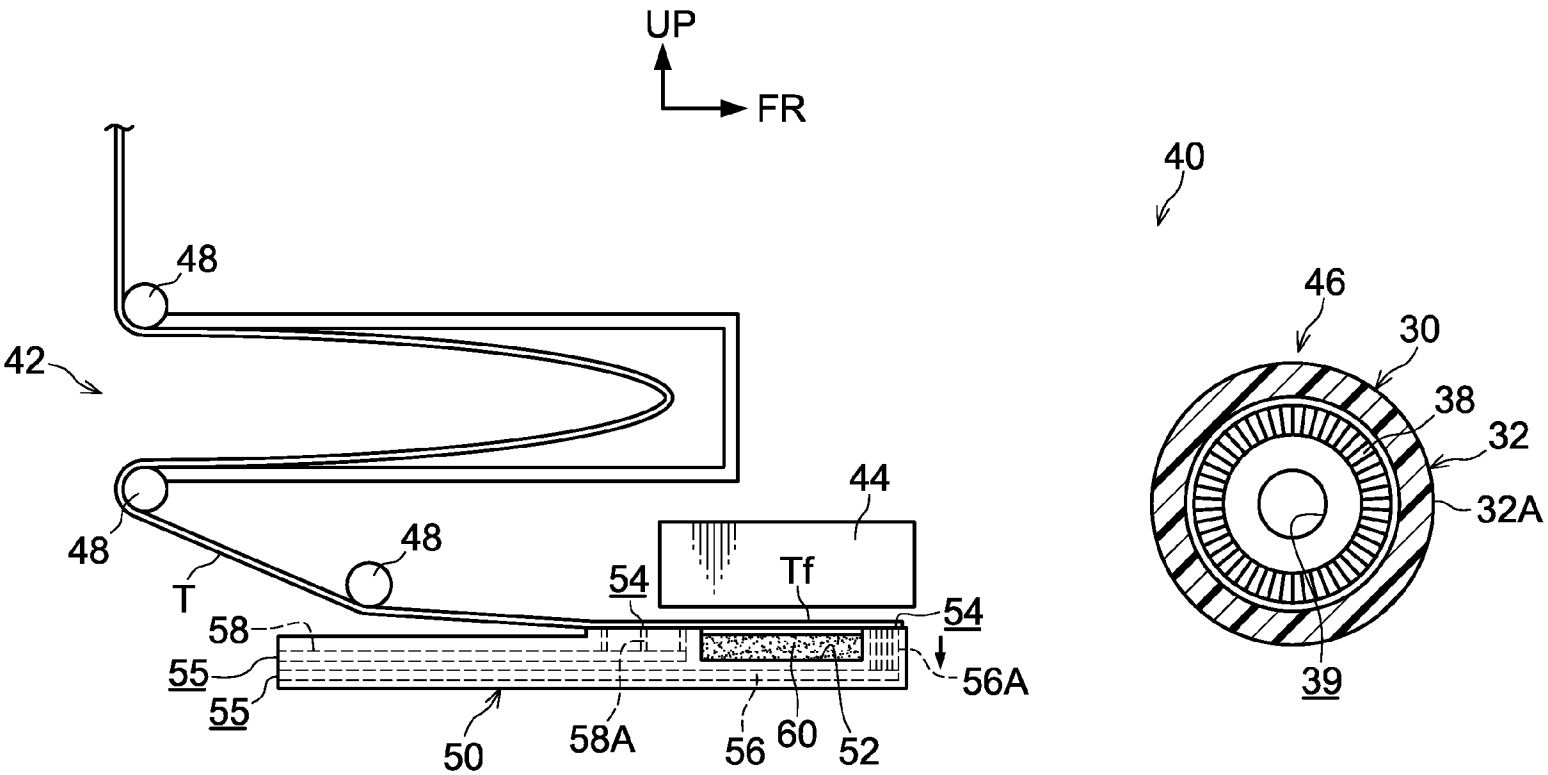
FIG. 5 is an explanatory view showing a step in which the holding mechanism has held the recording tape which has been held at the suction platform.

In this state, when the step of winding the recording tape T on the reel hub 32 begins, first, as shown in FIG. 4, the holding mechanism 50 undergoes ascending movement. Then, as shown in FIG. 5, the free end portion Tf of the recording tape T, which is being held by suction at the suction platform 44, is held by suction from the lower surface side thereof. That is to say, due to air being sucked from the respective through holes 54 by the air suction and supply device, the free end portion Tf of the recording tape T is held by suction at the upper surface 50A of the holding mechanism 50.

Then, when the holding mechanism 50 sucks the free end portion Tf of the recording tape T, the air suction device, which is communicated and connected with the suction platform 44, stops, and the suction with respect to the recording tape T is released. Incidentally, it should be noted that a configuration may be provided wherein another air suction and supply device is communicated and connected with the suction platform 44, and when the free end portion Tf of the recording tape T is transferred to the holding mechanism 50, air is blown out from the respective through holes of the suction platform 44 so that the transfer operation is quickly carried out.

Figure 6:
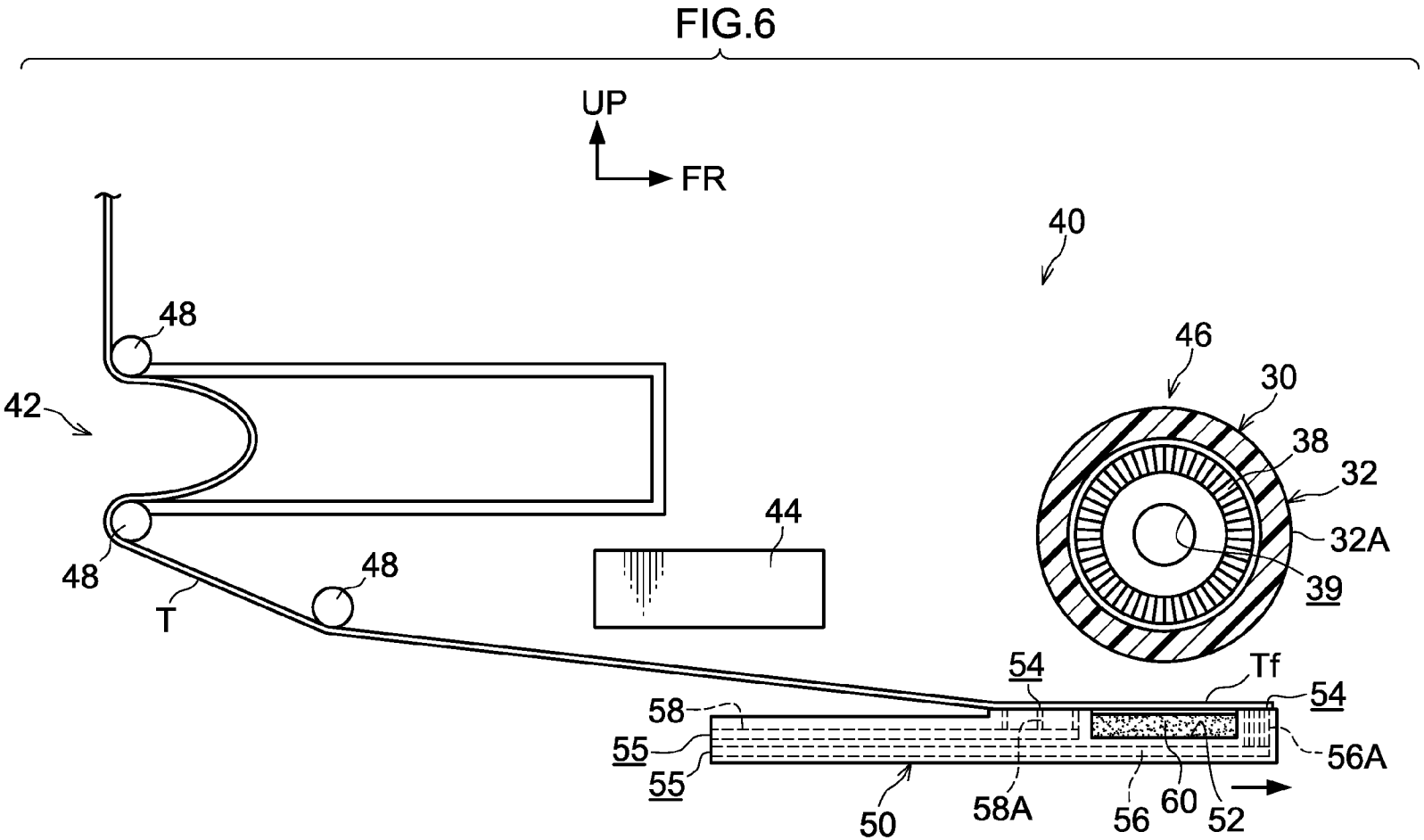
FIG. 6 is an explanatory view showing a step in which the holding mechanism which has held the recording tape has moved toward a reel hub side.

In this manner, the holding mechanism 50 holding by suction the free end portion Tf of the recording tape T at the upper surface 50A undergoes a little descending movement so as to separate from the suction platform 44 as shown in FIG. 5, and next, undergoes forward movement to a predetermined position directly under the reel hub 32 as shown in FIG. 6. Then, as shown in FIG. 7, the holding mechanism 50 positioned directly under the reel hub 32 undergoes ascending movement to a predetermined height to press the elastic body 60 provided in the concave portion 52 against the outer peripheral surface 32A of the reel hub 32.

That is to say, due to the holding mechanism 50 being raised by the moving mechanism such as an air cylinder or the like, the free end portion Tf of the recording tape T, which is present on the elastic body 60, is pressure contacted with the outer peripheral surface 32A of the reel hub 32 at a predetermined pressure. Incidentally, it should be noted that, at this time, since the elastic body 60 is relatively pressed downward by the outer peripheral surface 32A of the reel hub 32 to appropriately elastically deform, a contacting surface area of the recording tape T with respect to the outer peripheral surface 32A of the reel hub 32 is well secured, and an attachment force of the recording tape T is improved as will be described later.

Accordingly, it is preferable that the pressing force of the elastic body 60 (holding mechanism 50) with respect to the reel hub 32 (outer peripheral surface 32A) by the moving mechanism is made as high as possible. That is to say, the higher the pressing force is, the more the elastic deformation amount of the elastic body 60 can be increased, and therefore, the contacting surface area of the recording tape T with respect to the outer peripheral surface 32A of the reel hub 32 can be increased. Incidentally, it should be noted that, in a case where the moving mechanism is configured by an air cylinder, the pressing force can be controlled according to pressure control thereof.

In this manner, once the free end portion Tf of the recording tape T has been pressed against (pressure contacted with) the outer peripheral surface 32A of the reel hub 32 with a predetermined pressure, as shown in FIG. 7 and FIG. 9A, the reel hub 32 is rotated for several seconds at a predetermined speed (for example, 300 rpm) in the direction of arrow A shown in the drawings (counter clockwise direction). That is to say, the outer peripheral surface 32A of the reel hub 32 slidingly contacts (is rubbed by) the recording tape T for a predetermined distance (for example, 2000 mm or more). As a result, as shown in FIG. 8 and FIG. 9B, the free end portion Tf of the recording tape T is attached to the outer peripheral surface 32A of the reel hub 32.

Figure 10:
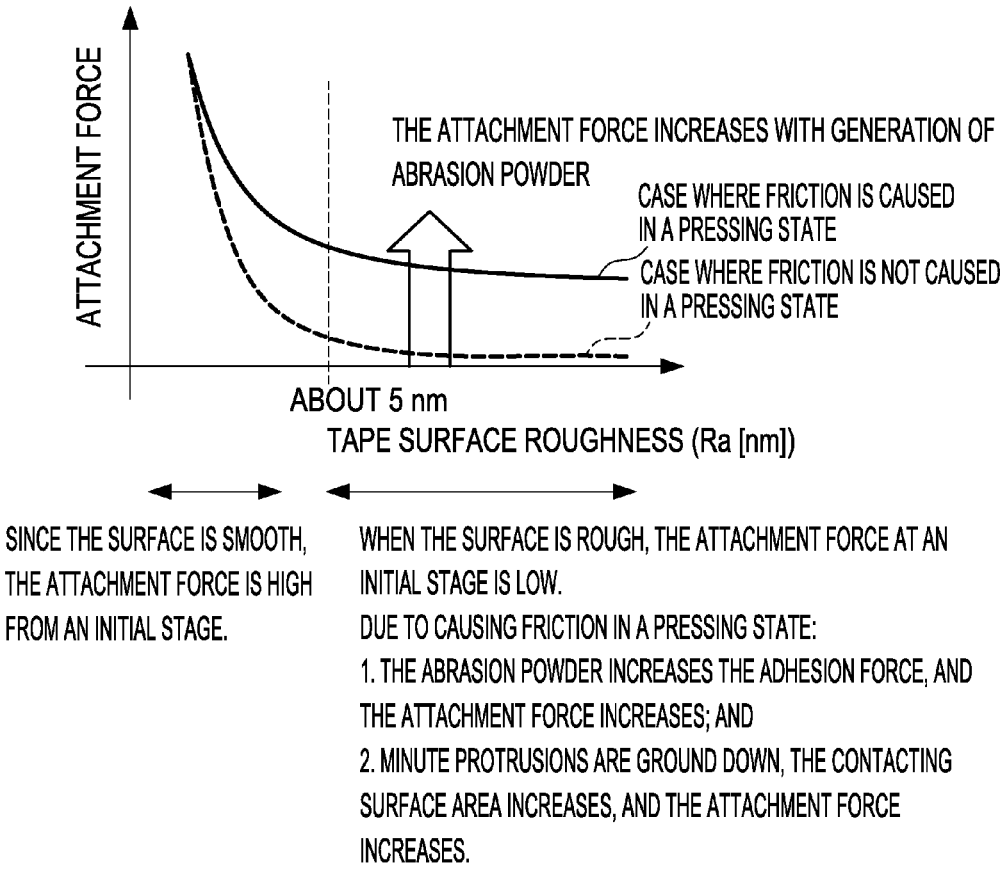
FIG. 10 is a graph showing a relationship between a surface roughness of the recording tape and an attachment force.

The attachment force of the recording tape T is determined according to a surface roughness Ra [nm] of a non-magnetic surface (hereinafter referred to as a "back surface Tb") which is the contacting surface of the recording tape T that contacts the outer peripheral surface 32A of the reel hub 32. That is to say, as shown in FIG. 10, in a case where the surface roughness Ra of the back surface Tb of the recording tape T is small (a smooth surface having an Ra of less than about 5 nm), since the frictional force with respect to the outer peripheral surface 32A of the reel hub 32 is large, the attachment force is high (attachment is easier). Accordingly, in this case, attachment is carried out even if a contacting time (contacting distance) of the reel hub 32 (outer peripheral surface 32A) with respect to the recording tape T is short.

However, in a case where the surface roughness Ra of the back surface Tb of the recording tape T is large (a rough surface having an Ra equal to or greater than about 5 nm), since the frictional force with respect to the outer peripheral surface 32A of the reel hub 32 is small, the attachment force is low (attachment is more difficult). Accordingly, in this case, the contacting time (contacting distance) of the reel hub 32 (outer peripheral surface 32A) with respect to the recording tape T is made longer, abrasion powder D is generated at the back surface Tb of the free end portion Tf, and the attachment force with respect to the reel hub 32 (outer peripheral surface 32A) is made higher by the abrasion powder D. This mechanism will be explained below based on FIG. 11A and FIG. 11B.

Figure 11A:
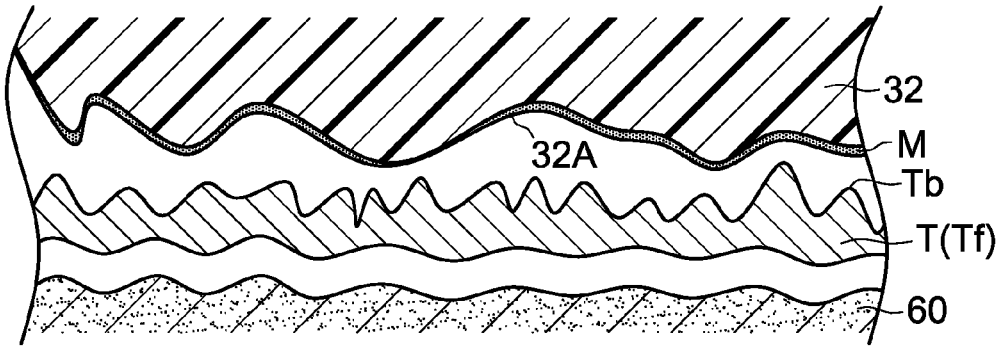
FIG. 11A is an explanatory view showing a state before the recording tape is pressed against the reel hub.
Figure 11B:
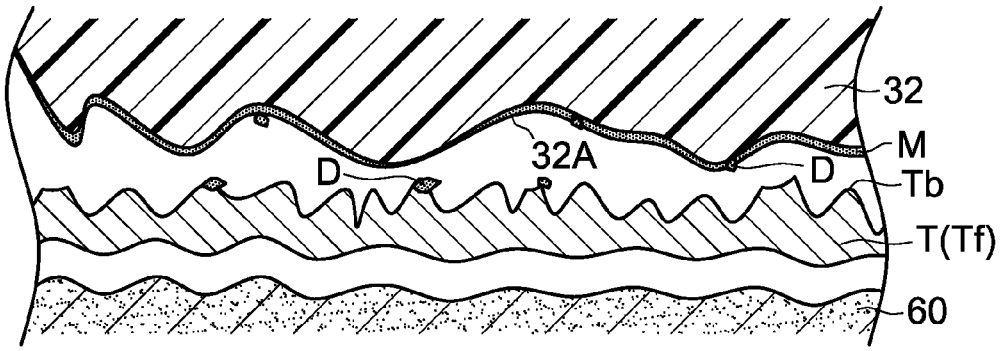
FIG. 11B is an explanatory view showing a state after the recording tape is pressed against the reel hub and the reel hub is rotated.

As shown in FIG. 11A, an oxide film M is formed at the outer peripheral surface 32A of the reel hub 32, and when the back surface Tb of the recording tape T and the outer peripheral surface 32A (oxide film M) of the reel hub 32 rub against each other in a state in which they are pressed against each other, a portion of the oxide film M is exfoliated, and minute protrusions at the back surface Tb are ground down, whereby abrasion powder D is generated and appears at the surface (back surface Tb) of the recording tape T, as shown in FIG. 11B.

As a result, the abrasion powder D attaches to the outer peripheral surface 32A of the reel hub 32 and is spread out by the sliding contact of the reel hub 32 with respect to the recording tape T, whereby the adhesion force thereof is increased (in particular, a surface energy at the outer peripheral surface 32A, at which the oxide film M has exfoliated, is raised, and the adhesion force thereof is increased). Accordingly, the abrasion powder D whose adhesion force has been increased carries out the role of an adhesive, and as a result, attachment force of the recording tape T (free end portion TO with respect to the outer peripheral surface 32A of the reel hub 32 is obtained.

Moreover, due to the minute protrusions at the back surface Tb of the recording tape T being ground down, the back surface Tb approaches a smooth surface, and therefore, frictional force with respect to the outer peripheral surface 32A of the reel hub 32 can also be increased. Thus, even in the case of the recording tape T in which the surface roughness Ra of the back surface Tb is large (which has a rough surface), the attachment force of the free end portion Tf with respect to the outer peripheral surface 32A of the reel hub 32 is increased, and the free end portion Tf attaches to the outer peripheral surface 32A of the reel hub 32.

Incidentally, it should be noted that the longer the contacting distance (contacting distance=circumferential length of reel hub 32 (mm)×rotation speed of reel hub 32 (rotation/sec)×time (sec)) of the outer peripheral surface 32A of the reel hub 32 and the recording tape T is, the more the generation amount of the abrasion powder D can be increased. Accordingly, increasing the contacting surface area of the recording tape T with respect to the outer peripheral surface 32A of the reel hub 32 by way of the elastic body 60 is effective.

Due to a mechanism such as explained above, the free end portion Tf of the recording tape T is attached to the outer peripheral surface 32A of the reel hub 32 without using a liquid for recording tape attachment such as alcohol or the like, and the faster the rotation speed of the reel hub 32 is at this time (at the time of sliding contact in which the recording tape T is pressed against and rubbed by the outer peripheral surface 32A of the reel hub 32), the more preferable it is. That is to say, if the contacting distance (frictional distance) is the same, since attachment can be carried out in a shorter time when the rotation speed of the reel hub 32 is faster, a production tact time (productivity) can be improved as a result.

In this manner, once the free end portion Tf of the recording tape T has been attached to the outer peripheral surface 32A of the reel hub 32, the rotation speed of the reel hub 32 is reduced (for example, to 60 rpm), air is supplied by the air suction and supply device, and as shown in FIG. 8, the air is blown out from the respective through holes 54 at the front side of the holding mechanism 50.

As a result, the free end portion Tf of the recording tape T is attached to the outer peripheral surface 32A of the reel hub 32, and the recording tape T is smoothly transferred from the holding mechanism 50 to the reel hub 32. That is to say, it is preferable that the holding mechanism 50 is provided with a configuration wherein air is blown out from at least the respective through holes 54 at the front side, and as a result, defects in transferring of the recording tape T and the like can be prevented from occurring.

In this manner, the free end portion Tf of the recording tape T is attached to the outer peripheral surface 32A of the reel hub 32, and as shown in FIG. 8, air is blown out from the respective through holes 54 at the rear side of the holding mechanism 50, or sucking of air from the respective through holes 54 is stopped, and suction of the recording tape T by the holding mechanism 50 is released. Thereafter, as shown in FIG. 9B, the holding mechanism 50 undergoes descending movement and separates from the reel hub 32.

Once the holding mechanism 50 has separated from the reel hub 32, the rotation drive gear of the rotation mechanism 46 rotates at a lower speed (for example, 60 rpm) than the aforementioned rotation speed at the time of sliding contact, while a predetermined tension (for example, about 1 g to 3 g in a case where the recording tape T has a thickness of 6.6 μm)

is applied to the recording tape T by the feed-out mechanism 42. As a result, a predetermined amount of the recording tape T is wound on the outer peripheral surface 32A of the reel hub 32.

Incidentally, it should be noted that, at this time, it is preferable that the tension (tape tension) applied to the recording tape T be made as small as possible. That is to say, in a case where, for example, the free end portion Tf of the recording tape T having the aforementioned thickness is attached and wound on the outer peripheral surface 32A of the reel hub 32, if the tension is greater than 3 g, there is a risk that the free end portion Tf of the recording tape T may significantly slip on the outer peripheral surface 32A of the reel hub 32 and peel off.

Accordingly, in a case where the free end portion Tf of the recording tape T having the aforementioned thickness is attached to the outer peripheral surface 32A of the reel hub 32, and then a predetermined amount of the recording tape T is wound on the reel hub 32, it is preferable that the tension of the recording tape T is made to be 3 g or less, and it is most preferable that this is carried out in a tension-free state.

The aforementioned steps are steps for temporary attachment of the recording tape T with respect to the reel hub 32, and when the free end portion Tf of the recording tape T is attached to the outer peripheral surface 32A of the reel hub 32 according to these temporary attachment steps, the free end portion Tf can be accurately attached to the outer peripheral surface 32A of the reel hub 32 (so that the longitudinal direction of the recording tape T becomes a direction orthogonal to the axis direction of the reel hub 32).

That is to say, for example, as shown in the comparative example shown in FIG. 15A through FIG. 15D, in a method wherein alcohol L serving as a liquid for recording tape attachment is coated with a predetermined width W (refer to FIG. 15A) on the outer peripheral surface 32A of the reel hub 32 to attach the free end portion Tf of the recording tape T thereto, since a drying speed of the alcohol L in a height direction (axis direction) of the reel hub 32 is not uniform, it becomes difficult to accurately carry out attachment (so that the longitudinal direction of the recording tape T becomes a direction orthogonal to the axis direction of the reel hub 32).

Figure 15A:
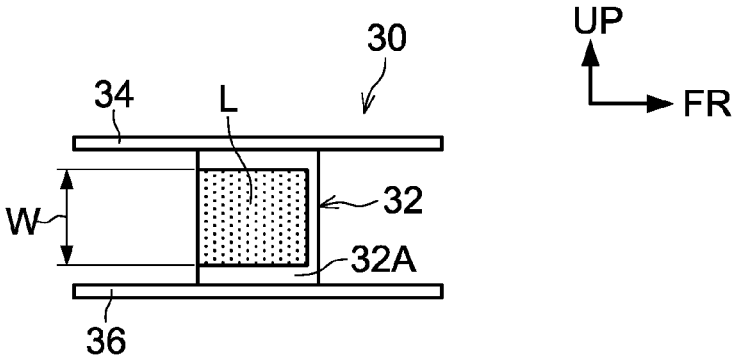
FIG. 15 A through FIG. 15D are schematic side views of a comparative example showing a recording tape that has been attached to a reel hub by way of alcohol.
Figure 15B:
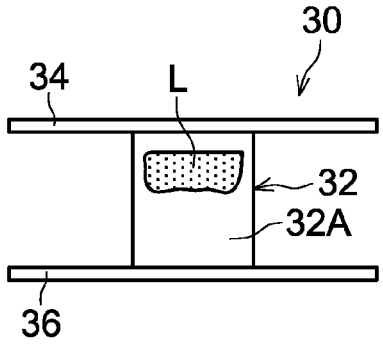
Figure 15C:
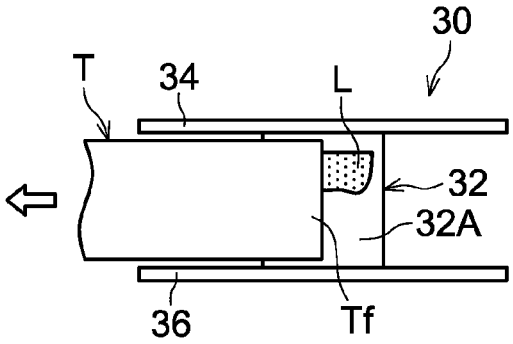

To explain more concretely, as shown in FIG. 15B and FIG. 15C, when the free end portion Tf of the recording tape T is attached to a portion where the alcohol L has been coated, in a case where, for example, substantially the half at the lower flange 36 side dries, and the alcohol L remains only at substantially the half at the upper flange 34 side, since the recording tape T is wound on the reel hub 32 in a state in which a certain amount of tension is applied, the free end portion Tf of the recording tape T is restrained at the site where attachment has been carried out, and there are cases where the free end portion Tf slants toward the upper flange 34 side (toward the axis direction of the reel hub 32).

Figure 15D:
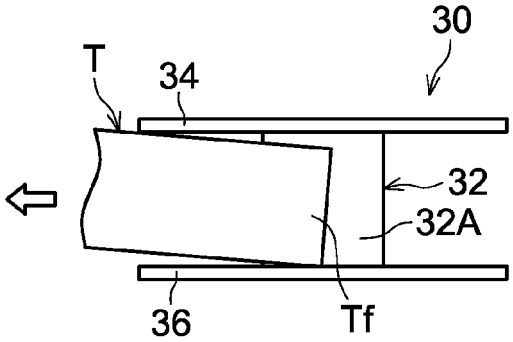

That is to say, as shown in FIG. 15D, the free end portion Tf of the recording tape T is attached at a slant with respect to a direction orthogonal to the axis direction of the reel hub 32, and when the recording tape T is wound on the reel hub 32 in this state, there are cases where the edge (width direction end portion) of the recording tape T hits the upper flange 34 and is bent over. In particular, this phenomenon notably occurs in a case where a clearance between the upper and lower flanges 34 and 36 is narrow (for example, 12.67 mm), or in a case where a thickness of the recording tape T becomes thin (for example, 6.6 μm) in order to increase a recording capacity.

In this manner, when a configuration is provided wherein a liquid for recording tape attachment such as the alcohol L or the like is coated on the outer peripheral surface 32A of the reel hub 32 to attach the free end portion Tf of the recording tape T thereto, particularly in a case where the thickness of the recording tape T has been made to be thinner than it has conventionally been, it has been difficult to accurately attach the free end portion Tf thereof to the outer peripheral surface 32A of the reel hub 32 (so that the longitudinal direction of the recording tape T becomes a direction orthogonal to the axis direction of the reel hub 32).

Figure 12:
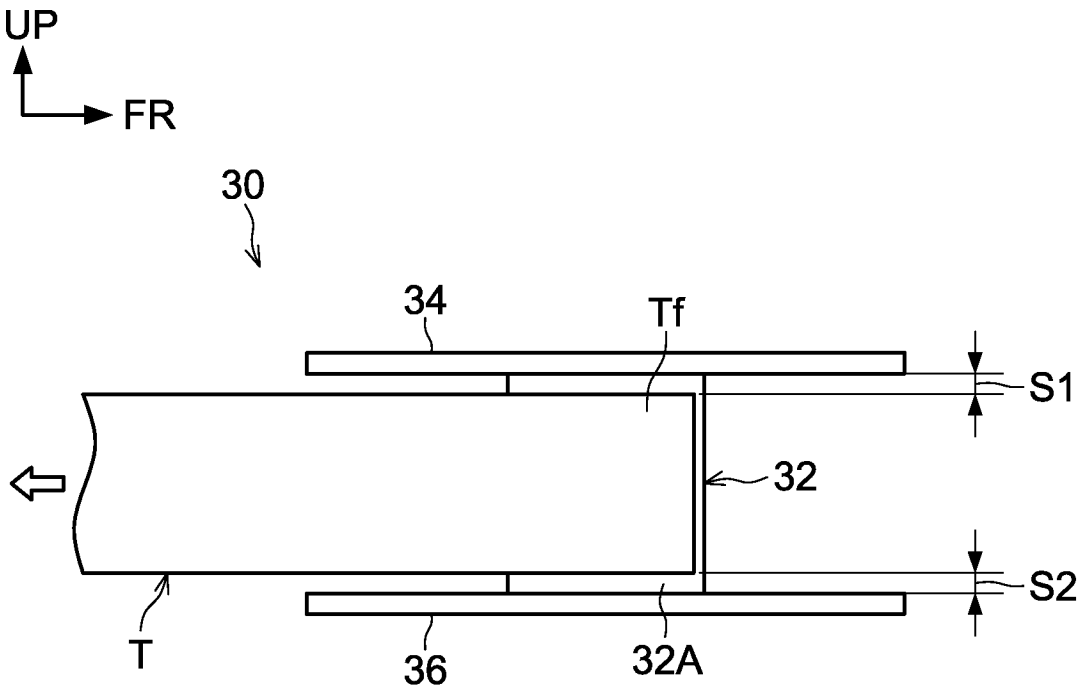
FIG. 12 is a schematic side view showing the recording tape which has been attached to the reel hub by way of frictional force or abrasion powder.

However, in the present exemplary embodiment, since a configuration is provided in which the free end portion Tf of the recording tape T is attached to the outer peripheral surface 32A of the reel hub 32 without using a liquid for recording tape attachment, a distribution of force in the height direction (axis direction) of the reel hub 32 becomes uniform, and attachment can be accurately carried out (so that the longitudinal direction of the recording tape T becomes a direction orthogonal to the axis direction of the reel hub 32). That is to say, as shown in FIG. 12, it becomes possible to carry out attachment in a state in which uniform clearances S1 and S2 are respectively formed between the edges of the recording tape T and the upper and lower flanges 34 and 36.

Incidentally, it should be noted that, even supposing that the recording tape T is attached in a state in which it is slanted in the height direction (axis direction) of the reel hub 32, since tension can be generated in the recording tape T due to the recording tape T being temporarily suctioned at the suction platform 44 while the reel hub 32 is being rotated, the posture of the recording tape T is corrected by this tension, and the recording tape can be made to slant only slightly. Thus, the edge of the recording tape T does not hit the upper and lower flanges 34 and 36, and even supposing that it does hit them, it is not bent over.

In this manner, once a predetermined amount of the recording tape T is wound on the reel hub 32, the process proceeds to a wind-up step. That is to say, the suction of the suction platform 44 is released, and the recording tape T is further wound for a predetermined amount. Then, the tension of the recording tape T is changed to a standard value by the feed-out mechanism 42, the rotation drive gear is rotated at an ultrahigh speed, and the recording tape T is sequentially wound on the reel hub 32. As a result, the reel 30 ultimately attains the state shown in FIG. 2B.

As explained above, when a configuration is provided wherein the outer peripheral surface 32A of the reel hub 32 and the free end portion Tf of the recording tape T are slidingly contacted with each other (rubbed against each other), and the free end portion Tf is attached to the outer peripheral surface 32A of the reel hub 32 by the frictional force between the two or the abrasion power D that is generated by this friction, since the attachment position of the free end portion Tf is not restrained compared with a configuration wherein a liquid for recording tape attachment such as the alcohol L or the like is coated on the outer peripheral surface 32A of the reel hub 32 to carry out attachment, fluctuation in the height direction (axis direction) of the reel hub 32 can be suppressed, and the attachment position of the free end portion Tf of the recording tape T can be stabilized.

Further, when a liquid for recording tape attachment such as the alcohol L or the like is coated to attach the free end portion Tf of the recording tape T to the outer peripheral surface 32A of the reel hub 32, there are cases where the free end portion Tf of the recording tape T is strongly attached to the outer peripheral surface 32A of the reel hub 32, and in such a case, when, for example, the drive device malfunctions and rotates the reel 30 so as to wind up the recording tape T until the end, since the recording tape T does not peel off from the outer peripheral surface 32A of the reel hub 32, there is a risk that a load may be applied to the drive device, and the drive device may break down.

However, when a configuration is provided wherein the free end portion Tf of the recording tape T is attached to the outer peripheral surface 32A of the reel hub 32 without using a liquid for recording tape attachment, even if the drive device malfunctions and rotates the reel 30 so as to wind up the recording tape T until the end, since the free end portion Tf of the recording tape T smoothly peels off from the outer peripheral surface 32A of the reel hub 32, a load is not applied to the drive device, and there is no risk that the drive device may break down.

Further, when a configuration is provided wherein the free end portion Tf of the recording tape T is attached to the outer peripheral surface 32A of the reel hub 32 without using a liquid for recording tape attachment, since an operation for coating a liquid for recording tape attachment such as the alcohol L on the outer peripheral surface 32A of the reel hub 32 becomes unnecessary, a production tact time is improved overall, and since a consumable item such as the alcohol L becomes unnecessary, a production cost can be reduced.

Further, since it is sufficient to cause the outer peripheral surface 32A of the reel hub 32 and the free end portion Tf of the recording tape T to slidingly contact each other (rub against each other), the rotation speed of the reel hub 32 at that time (the time of sliding contact) can be made a higher speed than a rotation speed of the reel hub 32 at the time of attaching the recording tape T. Accordingly, the production tact time can be improved as a result of this as well. Further, since it is sufficient to cause the outer peripheral surface 32A of the reel hub 32 and the free end portion Tf of the recording tape T to slidingly contact each other, there is also an advantage in that positioning precision of the outer peripheral surface 32A of the reel hub 32 and the elastic body 60 provided at the holding mechanism 50 is not demanded to such a great extent.

A probability of occurrence of bending of an edge (folds at an edge) of the recording tape T in the reel 30 obtained by the recording tape T, whose free end portion Tf has been attached according to the aforementioned temporary attachment step, being wound thereon according to the aforementioned wind-up step is shown in Table 1. As shown in Table 1, in a case where the free end portion Tf of the recording tape T was attached to the outer peripheral surface 32A of the reel hub 32 according to the winding method relating to the present exemplary embodiment, bending of an edge of the recording tape T did not occur at all. Accordingly, the winding method relating to the present exemplary embodiment is extremely effective.

TABLE 1

| | Probability of occurrence bending of an edge |
|---|---|
| Attachment according to the present winding method | 0/100 (0%) |
| Attachment by alcohol | 20/100 (20%) |

Figure 13:
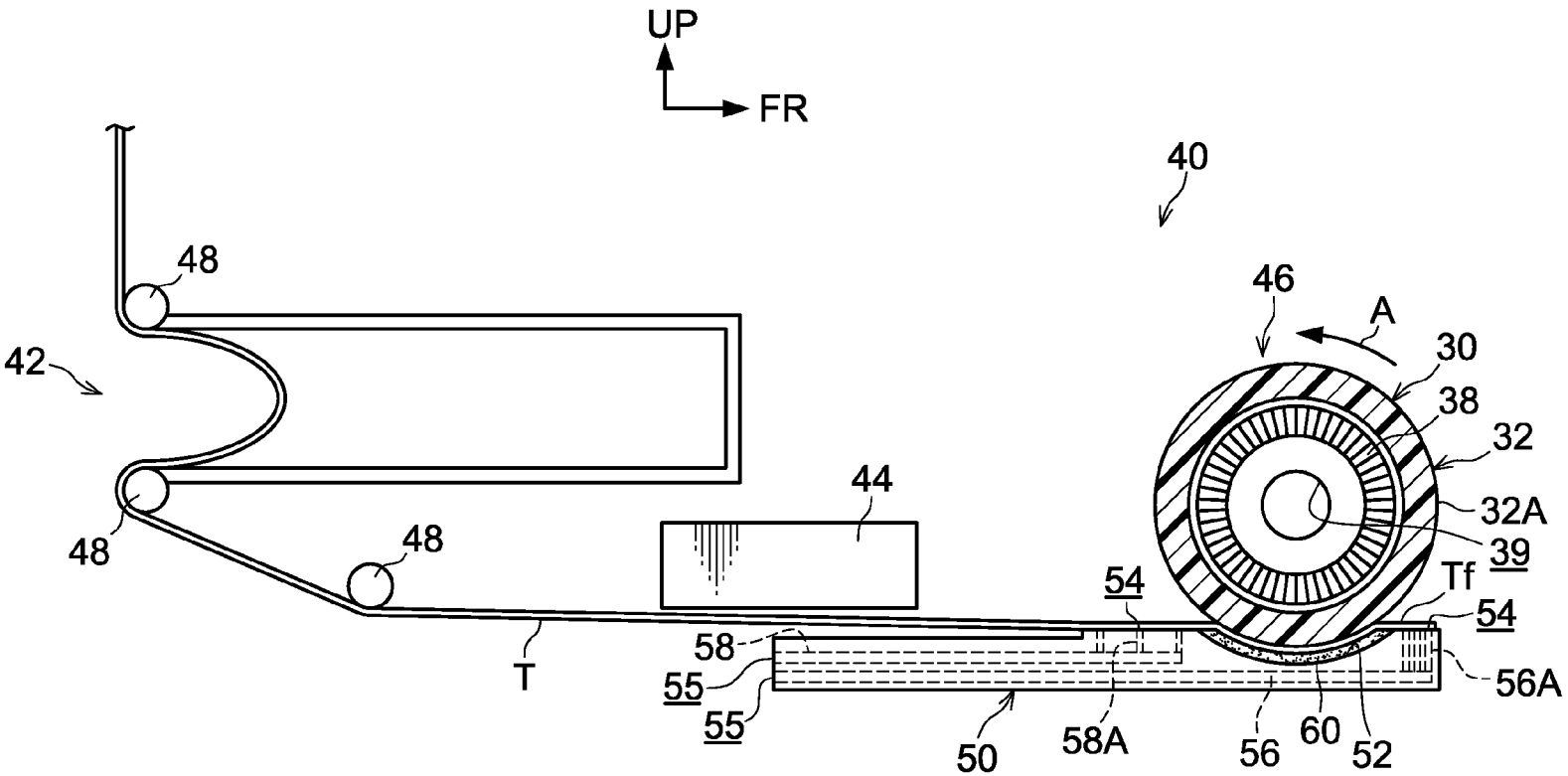
FIG. 13 is an explanatory view showing a step in which the reel hub, against which the recording tape which has been held by another holding mechanism has been pressed, is rotated.

Incidentally, it should be noted that the shapes of the concave portion 52 and the elastic body 60 of the holding mechanism 50 may be the shapes shown in FIG. 13. That is to say, the concave portion 52 of the holding mechanism 50 may be formed with a curved surface shape having a substantial circular arc shape when seen from a side surface view, and the elastic body 60 may also be formed with a curved surface shape having a substantial circular arc shape when seen from a side surface view, along the shape of the concave portion 52. However, it is preferable that a curvature of the concave portion 52 and the elastic body 60 in this case is made to be equal to or less than a curvature of the reel hub 32.

That is to say, as described above, in order to attach the free end portion Tf of the recording tape T to the outer peripheral surface 32A of the reel hub 32, it is preferable that the contacting surface area between the outer peripheral surface 32A of the reel hub 32 and the recording tape T be as large as possible. Accordingly, it is preferable to provide a configuration wherein the concave portion 52 and the elastic body 60 are formed with a curved surface shape (substantial circular arc shape when seen from a side surface view) having a curvature that is equal to or less than a curvature of the outer peripheral surface 32A of the reel hub 32, and the contacting surface area thereof is well secured.

Figure 14:
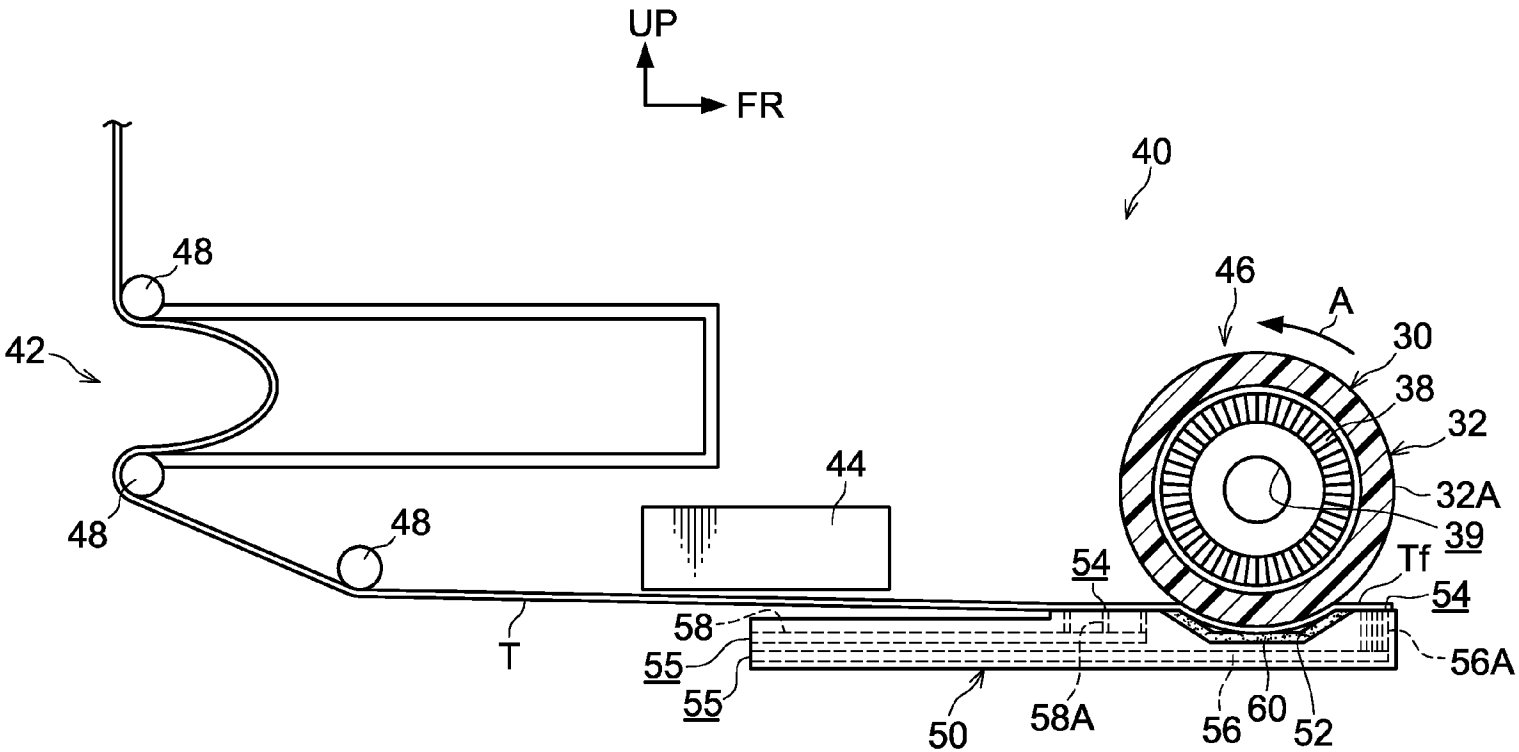
FIG. 14 is an explanatory view showing a step in which the reel hub, against which the recording tape which has been held by another holding mechanism has been pressed, is rotated.

Further, the shapes of the concave portion 52 and the elastic body 60 of the holding mechanism 50 may be the shapes shown in FIG. 14. That is to say, the concave portion 52 of the holding mechanism 50 may be formed with a substantial "V" shape, whose bottom surface is made to be a flat surface, when seen from a side surface view, and the elastic body 60 may also be formed with a substantial "V" shape, whose bottom surface is made to be a flat surface, when seen from a side surface view, along the shape of the concave portion 52. In this case as well, the contacting surface area of the elastic body 60 with respect to the outer peripheral surface 32A of the reel hub 32 is well secured.

Incidentally, it should be noted that, in the case of the holding mechanism 50 having the elastic body 60 having the substantial "V" shape, whose bottom surface is made to be a flat surface, when seen from a side surface view, there is an advantage in that application thereof is possible even if the curvature of the reel hub 32 is changed. That is to say, there is an advantage in that, even in a case where a diameter of the reel hub 32 is slightly changed, the free end portion Tf of the recording tape T can be pressure contacted with the outer peripheral surface 32A of the reel hub 32 (the contacting surface area can be secured).

Although the web winding method and the web winding apparatus relating to the present exemplary embodiment have been explained above based on the examples shown in the drawings, the web winding method and web winding apparatus relating to the present exemplary embodiment are not limited to the examples illustrated in the drawings, and appropriate design modifications are possible with a scope that does not depart from the gist of the present invention.

For example, in the aforementioned examples, although the recording tape T has been employed as one example of the web, the web relating to the present exemplary embodiment is not limited thereto, and it is also possible to apply the invention to a cleaning tape (a tape that cleans a recording and playback head of a drive device) or the like. Further, in the recording tape cartridge 10 illustrated in the drawings, although a configuration is provided wherein the door 28 slides in a linear shape along the right wall 12A to open and close the opening 18, a configuration may be provided wherein, for example, the door 28 is formed with a substantial circular arc shape when seen in plan view and slides over a predetermined circumference to open and close the opening 18.

What is claimed is:

1. A web winding method for winding a web on a winding core, the method comprising:

rotating the winding core by a predetermined amount while pressing an end portion of the web, which is held by a holding mechanism, against the winding core, predetermined amount being set such that an attachment force between the winding core and the end portion of the web is generated by the winding core and the end portion of the web rubbing against each other, and thereafter, carrying out temporary attachment by attaching the end portion of the web to the winding core by releasing the holding by the holding mechanism; and after the temporary attachment by generation of the attachment force, starting rotation of the winding core to wind up the web on the winding core.

2. The web winding method of claim 1, wherein the temporary attachment comprises generating abrasion powder on a contacting surface of the web that contacts the winding core, and attaching the end portion of the web to the winding core by way of the abrasion powder.

3. The web winding method of claim 1, wherein the temporary attachment comprises supporting the end portion of the web with an elastic body provided at the holding mechanism to press the end portion of the web against the winding core.

4. The web winding method of claim 1, wherein, in the temporary attachment, a rotation speed of the winding core when the web is being pressed against the winding core is a higher speed than a rotation speed of the winding core at the time of attaching the web to the winding core.

5. The web winding method of claim 1, wherein, in the temporary attachment, air is blown out from the holding mechanism toward the web when the holding by the holding mechanism is released.

6. The web winding method of claim 1, wherein the end portion of the web is held against the winding core by non-liquid means.

7. A web winding apparatus comprising:

a rotation mechanism that rotates a winding core;

a holding mechanism that is configured to be able to hold a web and configured to be able to move; and a controller that controls the rotation mechanism and the holding mechanism so that the winding core is rotated by a predetermined amount while an end portion of the web, which is held by the holding mechanism, is pressed against the winding core, the predetermined amount being set such that an attachment force between the winding core and the end portion of the web is generated by the winding core and the end portion of the web rubbing against each other, and thereafter, the winding core is rotated after the holding by the holding mechanism is released.

8. The web winding apparatus of claim 7, further comprising an elastic body that is provided at the holding mechanism and supports the end portion of the web when the end portion of the web is pressed against the winding core.

9. The web winding apparatus of claim 8, wherein the elastic body is provided within a concave portion formed at the holding mechanism.

10. The web winding apparatus of claim 9, wherein the elastic body is formed with a curved surface shape having a curvature that is equal to or less than a curvature of the winding core.

11. The web winding apparatus of claim 7, wherein the holding mechanism is configured to hold the web by sucking in air, and to release the web by blowing out air.

12. The web winding apparatus of claim 7, wherein the end portion of the web is held against the winding core by non-liquid means.

13. A producing method of a web obtained by winding the web on a winding core, the method comprising:

rotating the winding core by a predetermined amount while holding an end portion of the web with a holding mechanism so that the end portion of the web is pressed against the winding core, the predetermined amount being set such that an attachment force between the winding core and the end portion of the web is generated by the winding core and the end portion of the web rubbing against each other, and thereafter, carrying out temporary attachment in which the end portion of the web is attached to the winding core by releasing the holding; and after the temporary attachment by generation of the attachment force, starting rotation of the winding core to wind up the web on the winding core.

14. The web producing method of claim 13, wherein the temporary attachment comprises generating abrasion powder on a contacting surface of the web that contacts the winding core, and the end portion of the web is attached to the winding core by way of the abrasion powder.

15. The web producing method of claim 13, wherein the temporary attachment comprises supporting the end portion of the web with an elastic body to press the web against the winding core.

16. The web producing method of claim 13, wherein, in the temporary attachment, a rotation speed of the winding core when the web is being pressed against the winding core is a higher speed than a rotation speed of the winding core at the time of attaching the web to the winding core.

17. The web producing method of claim 13, wherein, in the temporary attachment, air is blown out toward the web when the holding of the web is released.

18. The web producing method of claim 13, wherein the end portion of the web is held against the winding core by non-liquid means.

* * * * *